US006220261B1

(12) United States Patent
Glatz

(10) Patent No.: US 6,220,261 B1
(45) Date of Patent: Apr. 24, 2001

(54) ADJUSTABLE STATIC UMBRELLA

(75) Inventor: Gustav Adolf Glatz, Frauenfeld (CH)

(73) Assignee: Glatz AG (CH)

( * ) Notice: Subject to any disclaimer, the term of this patent is extended or adjusted under 35 U.S.C. 154(b) by 0 days.

(21) Appl. No.: 09/242,654

(22) PCT Filed: Aug. 21, 1997

(86) PCT No.: PCT/CH97/00308

§ 371 Date: Feb. 19, 1999

§ 102(e) Date: Feb. 19, 1999

(87) PCT Pub. No.: WO98/08411

PCT Pub. Date: Mar. 5, 1998

(30) Foreign Application Priority Data

Aug. 28, 1996 (CH) ..... 2110/96

(51) Int. Cl.[7] ..... A45B 17/00; A45B 23/00

(52) U.S. Cl. ..... 135/20.3; 135/20.1; 135/21; 135/98

(58) Field of Search ..... 135/20.3, 21, 98, 135/15.1, 20.1

(56) References Cited

U.S. PATENT DOCUMENTS

| | | | |
|---|---|---|---|
| 3,120,238 | * | 2/1964 | Glatz . |
| 3,419,295 | * | 12/1968 | Small . |
| 3,486,514 | * | 12/1969 | Prescott . |
| 4,606,366 | | 8/1986 | Collet . |
| 5,678,585 | * | 10/1997 | May . |

FOREIGN PATENT DOCUMENTS

| | | |
|---|---|---|
| 407 136 | 1/1935 | (BE) . |
| 32 29 776 | 4/1983 | (DE) . |
| 324 057 | 1/1930 | (GB) . |
| 359 459 | 1/1931 | (GB) . |
| 450 919 | 1/1936 | (GB) . |

* cited by examiner

*Primary Examiner*—Robert Canfield
(74) *Attorney, Agent, or Firm*—George Pappas

(57) ABSTRACT

Disclosed is an adjustable static umbrella with a static mast (2) to which an arm (10) is secured by means of a hinge (12) allowing for the arm to be either adjusted into a use position or collapsed into a rest position and to be tipped about the hinge (12) tilting axle (14) perpendicular to the mast axis. The hinge (12) has toggle head (80) and a pair of shells (82, 82') symmetrically inverted one to each other, encompassing the toggle head (80) therein and rotatably mounted about the tilting axle (14), while the pair of hinge shells (82, 82') is provided with a length guide perpendicular to the tilting axle (14), in which the arm (10) is inserted. A locking device (90) includes a tilting hinge (92) parallel to the tilting axle (14) and a fastening device (94) allowing for the hinge shells to be pressed one against the other and against the toggle head (80) so that, when said fastening device in the length guide (84) is pulled, the arm cannot be displaced, while the hinge shells (82, 82') encompassing the toggle head cannot be twisted due to pairs of interactive contact surfaces. Releasing the locking device (94) loosens the arm (10) length guide (84), thereby enabling adjustment of the arm, in the area of a tilt angle (α) limited by two end-stops (116, 116', 118, 120), between a rest position and a use position.

20 Claims, 3 Drawing Sheets

ADJUSTABLE STATIC UMBRELLA

TECHNICAL FIELD

The invention relates to a static umbrella which is collapsible and which has a tiltable mast.

BACKGROUND OF THE INVENTION

Static umbrellas of the type mentioned at the outset are known from a number of sources, thus, for example, from DE 32 29 776 A1. The static umbrella described there has a telescopable static mast which comprises a hollow-constructed lower mast part and an upper mast part longitudinally slidable in this and turnably arranged about the mast axis, in which the mutual longitudinal slidability and turnability are adjustable and arrestable by means of a connecting member. On the static mast there is arranged an arm movable in and out by means of a hinge, as well as tiltably about tilting axis of the hinge standing perpendicular to the mast axis. The arm carries on the end away from the mast a collapsible umbrella, and the hinge is provided with an arresting device, by means of which all movements of the hinge are releasable and blockable, respectively.

The known hinge has the disadvantage that on freeing of the tiltability of the arm there is present the danger of an inadvertent folding-down of the umbrella-side end of the arm. Thereby not only is the handling of the umbrella made difficult or even made impossible, but there is also present the danger of injury to the operating person. The disadvantages are further increased by the fact that the freeing of the tiltability of the arm is accompanied by a freeing of the longitudinal slidability, whereby there is yielded the additional hazard of the sliding-out of the arm from the hinge.

SUMMARY OF THE INVENTION

The problem of the invention is to improve a static umbrella of the type mentioned at the outset so that a simpler and safer handling is possible.

The problem is solved according to the invention by a static umbrella which permits a safer and jolt-free moving in and out of the arm.

Through the fact that the hinge is freed only in a restricted angular range, the moving in and out of the arm can be performed safely and without jolts, since a tipping over of the arm carrying the umbrella onto the operating person is excluded and therewith an injury hazard to the operating person is averted. Furthermore, the moving in and out as well as the tilting of the arm becomes simpler and more comfortable.

The formation of the hinge with an open manner of construction is especially suited, furthermore, for an optimal surface treating, such as electrostatic finishing or coating. Furthermore, assembling and maintenance of the components are facilitated.

One advantage of the static umbrella is an especially safe arresting device, by means of which the tilting angle of the arm is dependably arrestable even without excessive tightening of the tensioning device.

Another advantage is execution of the longitudinal guide of the arm. This is suited both for straight and also for curved arms. By the use of non-rotational symmetrical transverse profiles there is avoided an undesired twisting of the arm about the axis of the longitudinal guide, even with released longitudinal guidance, i.e. during the moving in and out of the arm. Another advantage is an especially preferred form of execution of the longitudinal guide, thanks to which the moving in and out of the arm is facilitated, since any yielding of the arm into the dividing gap of the longitudinal guide, conditioned by lever effect, which would have resulted in an increased tension resistance in the arresting of the hinge is prevented. The gearing profiles contribute moreover to the parallel guidance of the hinge shells.

Yet another advantage is the arrangement of the tension device of the hinge is yielded. Since the tensioning device is located between the togglehead and the longitudinal guide of the arm, in the tightening of the tensioning device there is ensured a dependable arresting both of the tiltability and also of the movability of the arm.

Another advantage is a preferred form of execution of the tensioning device, which allows a simple and safe operation and, in particular, precludes an undesired complete unscrewing of the tensioning screw and the danger of an unintended disassembling of the hinge.

BRIEF DESCRIPTION OF THE DRAWINGS

Examples of execution of the static umbrella according to the invention are described in detail in the following with the aid of the drawings, in which.

DESCRIPTION OF THE PREFERRED EMBODIMENTS

Figure 1:
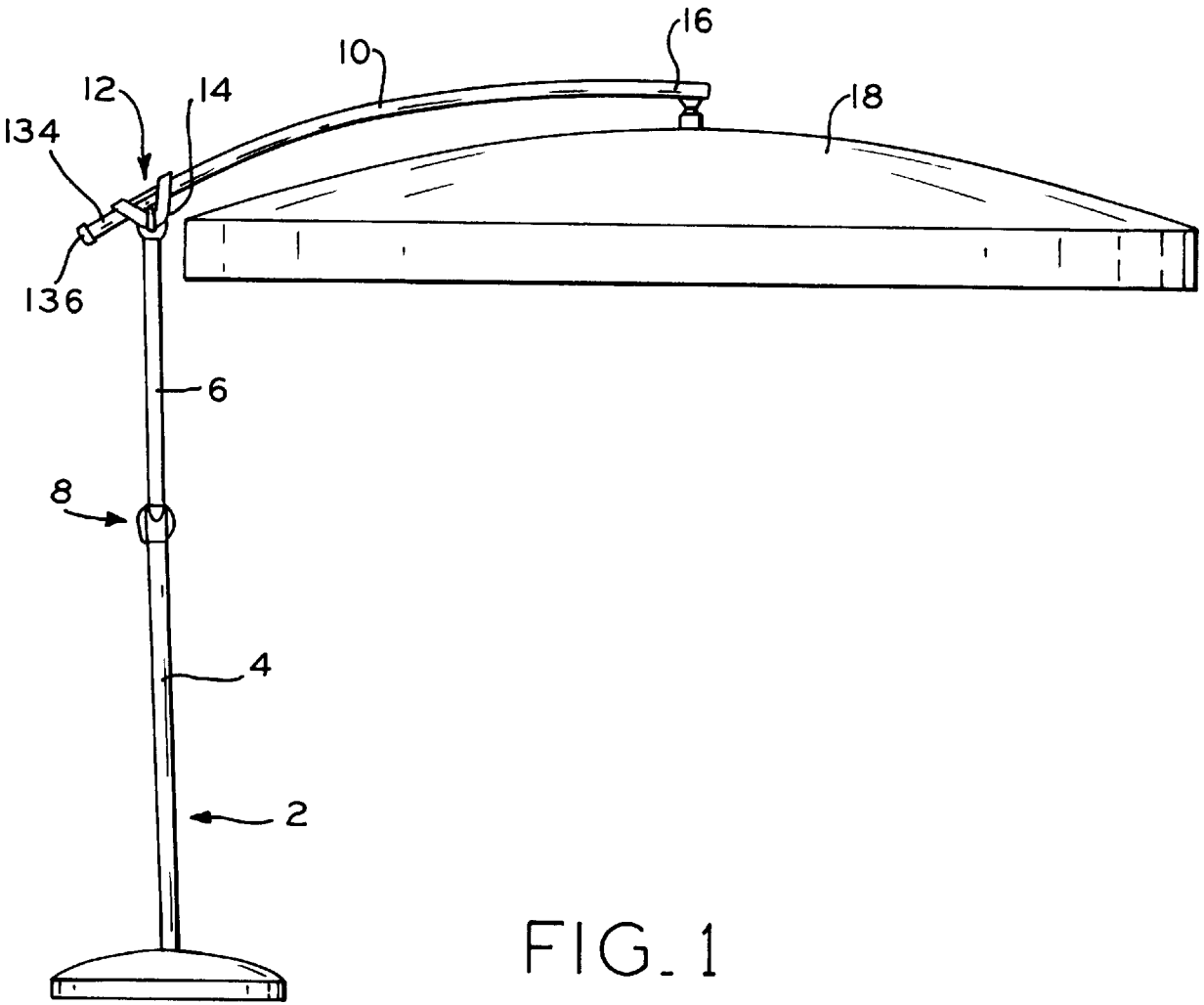
FIG. 1 shows a static umbrella in working position, in side view.
Figure 2:
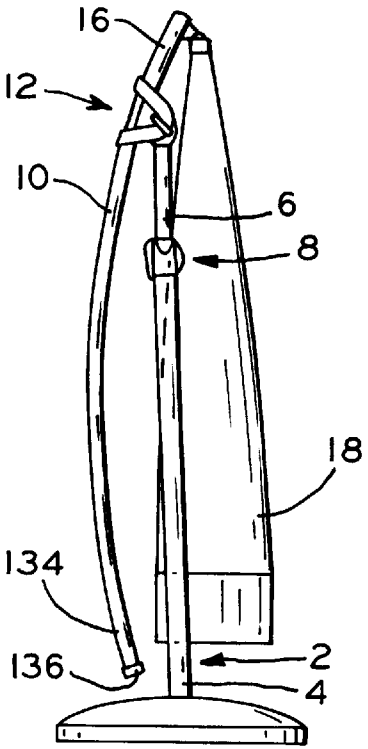
FIG. 2 shows the static umbrella of FIG. 1 in rest position, in side view.
Figure 3:
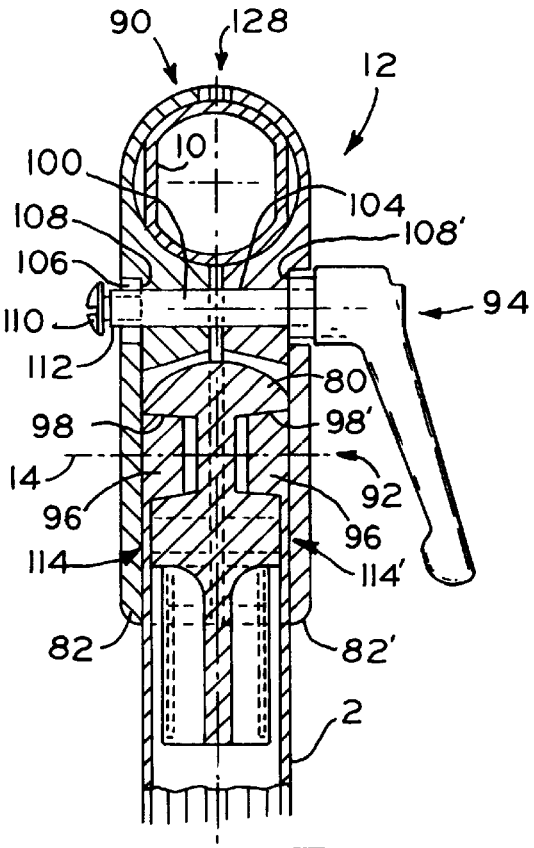
FIG. 3 shows a hinge in the working position of the static umbrella, according to the section XII—XII of FIG. 4.
Figure 6:
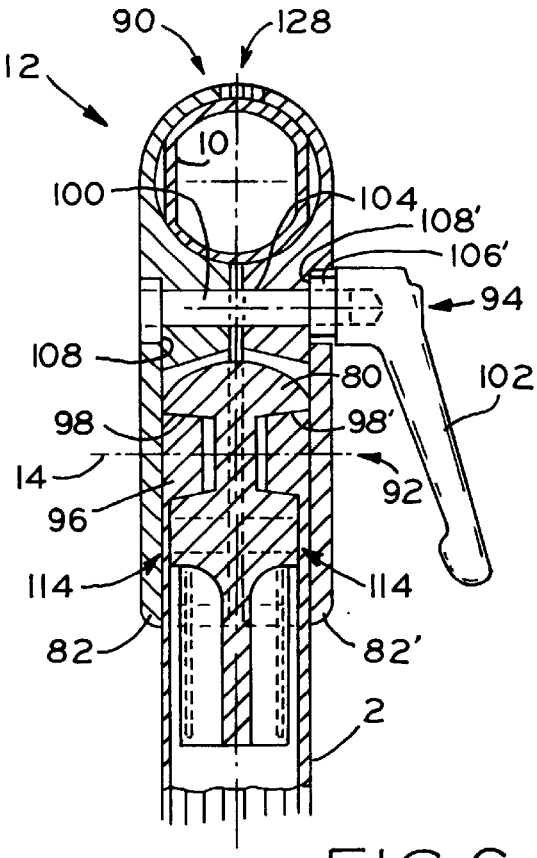
FIG. 6 shows a hinge with a modified tensioning device, in the representation of FIG. 3.
Figure 8:
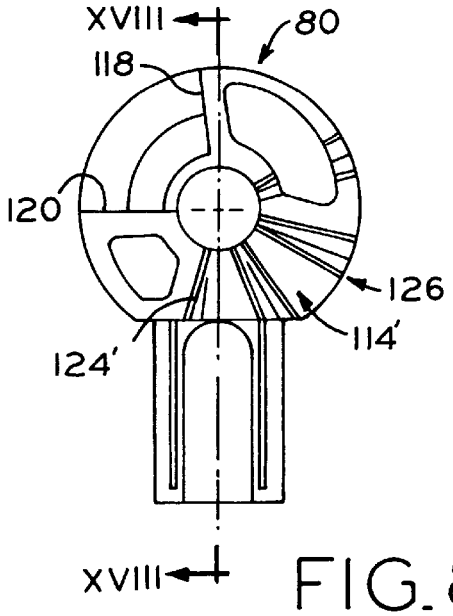
FIG. 8 shows the togglehead of the hinge, in side view.
Figure 9:
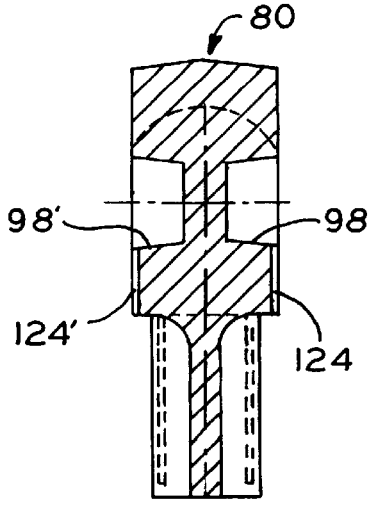
FIG. 9 shows the togglehead of FIG. 8, according to the section XVIII—XVIII of FIG. 8.
Figure 5:
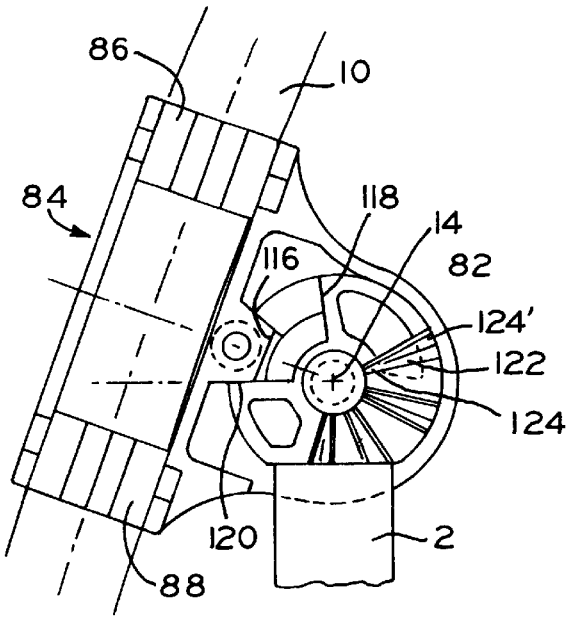
FIG. 5 shows the hinge of FIG. 3 in the rest position of the static umbrella, in which one hinge shell was removed, as seen from the side of the missing hinge shell.
Figure 4:
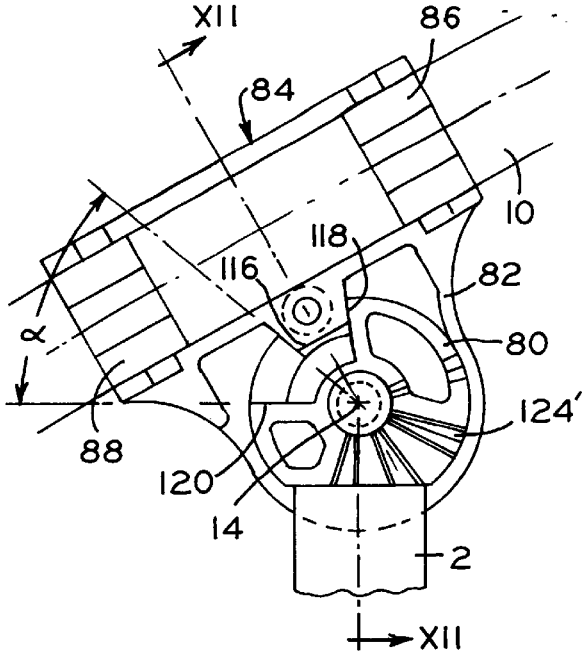
FIG. 4 shows the hinge of FIG. 3 in the working position of the static umbrella, in which one hinge shell was removed, as seen from the side of the missing hinge shell.
Figure 7A:
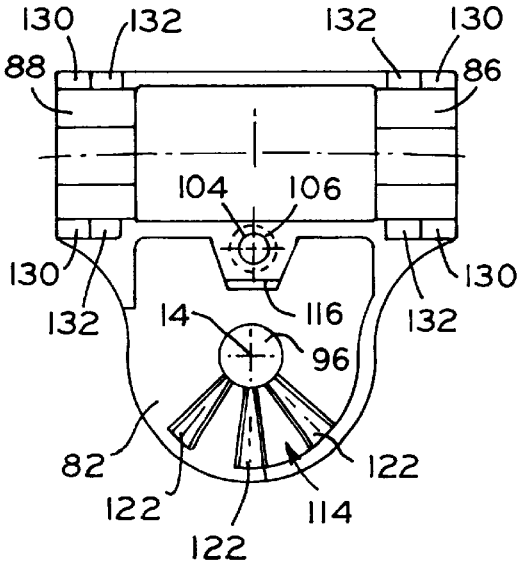
FIGS. 7(*a*) and 7(*b*) show a hinge shell pair of the hinge, in each case as seen from the inside.
Figure 7B:
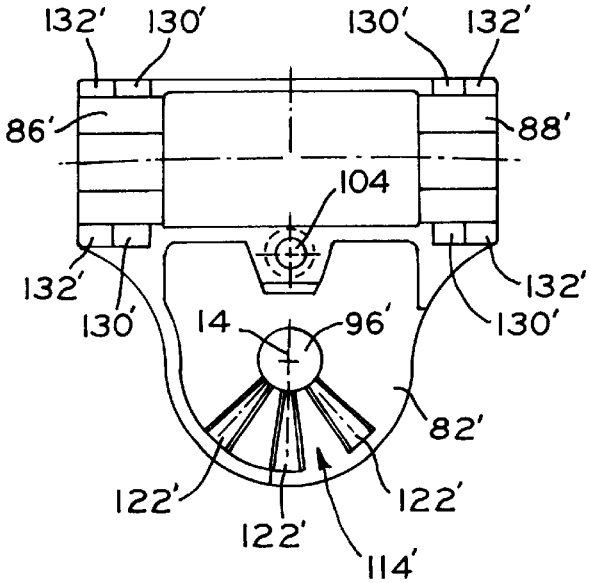

FIGS. 1 and 2 show an example of execution of a free-arm umbrella with a telescopable static mast 2, which has a hollow -constructed first mast part 4 as well as a second mast part 6, in which the two mast parts are arrestably connected with one another by means of a connecting member 8. The second mast part 6 is longitudinally slidable in the first mast part 4 and turnable with respect to this about the common axis of the two mast parts. An arm 10 is borne movably in and out by means of a hinge 12 arranged on the tip of the static mast 2. The hinge 12 permits, furthermore, a tilting of the arm 10 about a tilting axis 14 standing perpendicular to the mast axis. On its end 16, away from the mast, the arm 10 carries a collapsible umbrella 18. In the working position of the static umbrella the telescopable static mast 2 as well as the arm 10 are approximately or entirely extended, in which case the arm 10 occupies an approximately horizontal tilting position. In the rest position of the static umbrella the second mast part 6 is thrust largely into the first mast part 4 and the arm 10 is in moved-in and approximately in vertical tilting position. In the example of execution shown, the arm 10 has a curved course; also straight-constructed arms, however, are usable. As is evident from FIGS. 1 and 2, with the curved arm there is yielded the advantage that with given dimensions of the static umbrella 18 between its rest position and its working position, a smaller tilting angle range is to be run through than in the case of a straight arm.

The hinge 12 of the static umbrella according to the invention is represented in detail in FIGS. 3 to 9. This comprises a togglehead 80 fastenable to the static mast 2, preferably to the mast tip, as well as a part of mirror-image-symmetrically arranged hinge shells 82, 82', turnably borne about the tilting axis 14, enclosing the togglehead 80. A longitudinal guide 84 for the reception of the arm 10 is arranged eccentrically and perpendicularly to the tilting axis 14 on the hinge shell pair 82, 82', in which arrangement a rotation of the hinge shell pair 82, 82' about the tilting axis 14 brings about a tilting of the longitudinal guide 84. The longitudinal profile of the longitudinal guide 84 is adapted to that of the arm 10. In the example of execution shown, the longitudinal guide 84 is constructed as a tube section divided in longitudinal direction, in which each half of the longitudinal guide 84 is arranged on an appertaining hinge shell 82 or 82' respectively. The longitudinal guide 84 is equipped with first and second guide surface pairs 86, 86' and 88, 88' for the reception of the arm 10 provided with a corresponding outer profile, which are arranged preferably in the end regions of the longitudinal guide 84, the two guides surfaces of a guide surface pair 86, 86' or 88, 88' being arranged on different hinge shells 82, 82'. Alternatively the togglehead 80 can be constructed directly on the mast tip.

An arresting device 90 of the hinge 12 comprises a tilting hinge 92 for the parallel aligning and tilting of the hinge shells 82, 82' about the tilting axis 14 and a tensioning device 94. The tilting hinge 92 represented contains in each case pin 96 or 96', arranged on the inside of the hinge shell 82 or 82', respectively, which pin is tiltably and axially slidable in an assigned recess 98 or 98' of the togglehead 80, in which arrangement the length of the pins 96, 96' and the depth of the recesses 98, 98' are to be chosen such that the hinge shells 82, 82' are axially slidable over a sufficient path, for example several millimeters. Other possibilities of the tilting hinge 94 can be provided; in particular the togglehead can be provided with cylindrical bearing bolts aligned along the tilting axis 14, on which the hinge shells 82, 82' are turnably and longitudinally slidable borne with corresponding bearing bushes.

The tensioning device 94 comprises a tensioning screw 100 with actuating lever 102 which is admitted through the transverse bore 104 lying through the hinge shells 82, 82', on the end of which bore a corresponding screw-threaded part 106 is present. In the screwing of the tensioning screw 100 into the threaded part 106 the hinge shells 82, 82' provided with steps 108 and 108' on the transverse bore 104 are pressed against one another and against the togglehead 80. In order to avoid an inadvertent complete unscrewing of the tensioning screw 100 and a disassembling of the hinge 12 associated with it, a security screw 110 is screwed into the end 112 away from the actuating lever 102 of the tensioning screw 100. In an alternative form of execution of the tensioning device 94 according to FIG. 6 the actuating lever 102 is mounted on the screw thread part 106'.

On the insides of the hinge shells 82, 82' and the outsides of the togglehead 80 there are formed contact surface pairs 114, 114' in such manner that with tightened tensioning device 94 the hinge shells 82, 82' enter into adhesion contact with the togglehead 80 or engage into one another, whereby the turnability of the hinge shells 82, 82', and therewith the tiltability of the arm 10 about the tilting axis 14, is arrestable. With tightened tensioning device 94, moreover, the guide surfaces 86, 86' and 88, 88' of the longitudinal guide 84 are pressed against one another and therewith against the arm 10, whereby this latter is arrestable against driving in the longitudinal guide 84. On releasing of the tensioning device 94 the longitudinal guide 84 of the arm 10 is freed and the contact surface pairs 114, 114' are separated from one another, whereby the tiltability of the arm 10 is freed. The total tilting range of the arm 10 is limited by two end stops which are reached, respectively, in the working or in the rest position of the static umbrella. As is evident from FIGS. 4 and 5, the end stops are formed by a projection 116 or 116', respectively facing toward the togglehead 80, which strikes against a corresponding upper stop surface 118 and lower stop surface 120 of a recess on the togglehead 80. The size of the recess determines the maximal tilt angle between the working and the rest positions of the hinge 12 and therewith of the arm 10.

The contact surface pairs 114, 114' can be constructed as pairs of surfaces provided with an adhesive coating, that are pressable against one another. In the example of execution shown the contact surface pairs 114 and 114' comprise sector-form rest projections 122 and 122' on the inside of the hinge shells 82 and 82', which engage into corresponding rest depressions 124 and 124' on the facing side of the togglehead 80. The angular division of the contact surface pairs 114, 114' here defined as the angle between two adjacent rest projections 122, 122' or two adjacent rest depressions 124, 124', corresponds in the example shown to the maximal tilt angle of the arm 10, which here amounts to approximately 40°. The angular position of the rest projections 122, 122' and rest depressions 124, 124' is chosen in such manner that the contact surfaces of a contact surface pair 114 or 114' engage in one another when the tilting position of the arm 10 corresponds either to the working or to the rest position. If necessary a finer angular division of the contact surface pairs 114, 114' could be chosen, in order to arrest the arm 10 also in intermediate positions of the tilt angle.

The transverse profile 126 of the contact surface pairs 114, 114', here defined as the corresponding transverse profile of the stop projections 122, 122' and stop depressions 124, 124', respectively, is such that the stop projections 122, 122' taper upward and the stop depressions 124, 124' converge downward, to form run-on surfaces which facilitate the interlocking and releasing of the contact surface pairs 114, 114'. This formation brings it about that with released tensioning device 94 the hinge shells 82, 82' are thrust apart in the driving in and out of the arm, since a force exerted by the user of the static umbrella on the arm 10 in its longitudinal direction also exerts a torque about the tilting axis 14 and brings about the spreading of the hinge shells 82, 82'. In a first opening phase with only slightly opened tensioning device 94 there occurs only a spreading of the hinge shells 82, 82' without any over-running of the contact surface pairs 114, 114', so that without any tilting of the arm 10 this arm, especially also in the case of a curved arm, is drivable in and out without jolting, and therefore easily. There can also be provided spring means, in order to push apart the two hinge shells 82, 82' after releasing of the tensioning device, in which case the corresponding spring forms is to be overcome in the tightening of the tensioning device 94. In a second opening phase of the tensioning device 94 this is opened so far that also the contact surface pairs 114, 114' are over-run and the hinge 12 and therewith the arm 10 can be tilted.

In order to prevent, during the driving in and out of the arm 10, a twisting of same about its longitudinal axis, the guide surfaces 86, 86' and 88, 88' as well as the arm 10 are provided with non-rotation-symmetric cross-section profiles corresponding to one another. Furthermore, the length guide 84 has one or more gearing profiles 128 in the zone of the longitudinal dividing, in which arrangement in each case a projection 130 of a half of the longitudinal guide 84 projecting over the longitudinal section plane engages into a corresponding recess 132 of the oppositely lying half of the longitudinal guide 84. In this manner there is prevented the possibility that through the releasing of the tensioning device 94 on the one hand there occurs a mutual swinging of the hinge shells 82, 82' and, on the other hand, through the mentioned division gap of the longitudinal guide 84 there occurs a yielding of the arm 10 in vertical direction, i.e. and unwanted releasing of the arm out of the longitudinal guide 84.

As is evident from FIGS. 1 and 2, the tilting position of the arm 10 is always so aligned that on an unintended releasing of the tensioning device 94 the arm 10 is forced into the driven-in rest position, whereby the risk of an inadvertent sliding of the arm 10 out of the hinge 12 is aggravated. If necessary, the umbrella-remote arm end 134 can be equipped with a security means against sliding out, for example with a bulge 136 that can be screwed on.

What is claimed:

1. A static umbrella with a static mast to which an arm is attached movably in and out by means of a hinge about a tilting axis of the hinge standing perpendicular to the mast axis, in which the arm carries on the mast-remote end a collapsible umbrella, and in which the hinge is provided with an arresting device, by means of which all movements of the hinge are releasable and arrestable, respectively, characterized in that the hinge comprises a togglehead fastenable to the static mast or formed on this, as well as a pair of mirror-symmetrically arranged hinge shells including the togglehead, turnably borne about the tilting axis, in which the hinge shell pair is provided with a longitudinal guide aligned perpendicularly to the tilting axis for the reception of the arm and in which the arresting device comprises a tilting hinge aligned parallel to the tilting axis and a tensioning device, by means of which the hinge shells are pressable against one another and against the togglehead, in such manner that with tightened tensioning device the arm is arrested against traveling in the longitudinal guide and furthermore the hinge shells are arrested against twisting with the togglehead by means of cooperating contact surface pairs, and that with released tensioning device the longitudinal guide of the arm is freeable and, furthermore, the arm is settable in a tilt angle range bounded by end stops between a rest position and a working position.

2. The static umbrella according to claim 1, characterized in that the contact surface pairs comprise interlocking, sector-form stop projections and stop depressions.

3. The static umbrella according to claim 2, characterized in that the longitudinal guide is divided in longitudinal direction and comprises guide surface pairs for the reception of the arm provided with a corresponding outer profile, in which in each case one guide surface or is arranged on a corresponding hinge shell eccentrically with respect to the tilting axis in such manner that with tightened tensioning device the guide surfaces are pressed against the arm and arrest this arm, while with released tensioning device at least the longitudinal sliding of the arm is freed.

4. The static umbrella according to claim 3, characterized in that the inner profile of the guide surfaces and the corresponding outer profile of the arm are non-rotation-symmetrical, in order to prevent a twisting of the arm about the longitudinal axis of the longitudinal guide.

5. The static umbrella according to claim 3, characterized in that the hinge shells have one or more gearing profiles on the longitudinal guide in the zone of the length division, in which in each case a projection of a half of the longitudinal guide engages into a corresponding recess of the oppositely lying half of the longitudinal guide.

6. The static umbrella according to claim 2, characterized in that the tensioning device is arranged between the togglehead and the longitudinal guide.

7. The static umbrella according to claim 2, characterized in that the tensioning device comprises a tensioning screw arranged in a transverse bore leading through the hinge shells, and an allocated screw thread part, in which arrangement preferably security means are present for the avoidance of an inadvertent complete unscrewing of the tensioning screw.

8. The static umbrella according to claim 1, characterized in that the longitudinal guide is divided in longitudinal direction and comprises guide surface pairs for the reception of the arm provided with a corresponding outer profile, in which in each case one guide surface is arranged on a corresponding hinge shell eccentrically with respect to the tilting axis in such manner that with tightened tensioning device the guide surfaces are pressed against the arm and arrest this arm, while with released tensioning device at least the longitudinal sliding of the arm is freed.

9. The static umbrella according to claim 8, characterized in that the inner profile of the guide surfaces and the corresponding outer profile of the arm are non-rotation-symmetrical, in order to prevent a twisting of the arm about the longitudinal axis of the longitudinal guide.

10. The static umbrella according to claim 9, characterized in that the hinge shells have one or more gearing profiles on the longitudinal guide in the zone of the length division, in which in each case a projection of a half of the longitudinal guide engages into a corresponding recess of the oppositely lying half of the longitudinal guide.

11. The static umbrella according to claim 9, characterized in that the tensioning device is arranged between the togglehead and the longitudinal guide.

12. The static umbrella according to claim 9, characterized in that the tensioning device comprises a tensioning screw arranged in a transverse bore leading through the hinge shells, and an allocated screw thread part, in which arrangement preferably security means are present for the avoidance of an inadvertent complete unscrewing of the tensioning screw.

13. The static umbrella according to claim 8, characterized in that the hinge shells have one or more gearing profiles on the longitudinal guide in the zone of the length division, in which in each case a projection of a half of the longitudinal guide engages into a corresponding recess of the oppositely lying half of the longitudinal guide.

14. The static umbrella according to claim 13, characterized in that the tensioning device is arranged between the togglehead and the longitudinal guide.

15. The static umbrella according to claim 13, characterized in that the tensioning device comprises a tensioning screw arranged in a transverse bore leading through the hinge shells, and an allocated screw thread part, in which arrangement preferably security means are present for the avoidance of an inadvertent complete unscrewing of the tensioning screw.

16. The static umbrella according to claim 8, characterized in that the tensioning device is arranged between the togglehead and the longitudinal guide.

17. The static umbrella according to claim 8, characterized in that the tensioning device comprises a tensioning screw arranged in a transverse bore leading through the hinge shells, and an allocated screw thread part, in which arrangement preferably security means are present for the avoidance of an inadvertent complete unscrewing of the tensioning screw.

18. The static umbrella according to claim 17 characterized in that the tensioning device is arranged between the togglehead and the longitudinal guide.

19. The static umbrella according to claim 18, characterized in that the tensioning device comprises a tensioning screw arranged in a transverse bore leading through the hinge shells, and an allocated screw thread part, in which arrangement preferably security means are present for the avoidance of an inadvertent complete unscrewing of the tensioning screw.

20. The static umbrella according to claim 1, characterized in that the tensioning device comprises a tensioning screw arranged in a transverse bore leading through the hinge shells, and an allocated screw thread part, in which arrangement preferably security means are present for the avoidance of an inadvertent complete unscrewing of the tensioning screw.

* * * * *